US009597262B2

(12) United States Patent
Morgan

(10) Patent No.: US 9,597,262 B2
(45) Date of Patent: Mar. 21, 2017

(54) MEDICATION ADMINISTRATION TRACKER

(71) Applicant: Daniel Paul Morgan, Siesta Key, FL (US)

(72) Inventor: Daniel Paul Morgan, Siesta Key, FL (US)

( * ) Notice: Subject to any disclaimer, the term of this patent is extended or adjusted under 35 U.S.C. 154(b) by 0 days.

(21) Appl. No.: 14/596,668

(22) Filed: Jan. 14, 2015

(65) Prior Publication Data

US 2016/0199261 A1 Jul. 14, 2016

(51) Int. Cl.

| | |
|---|---|
| ***G04G 13/00*** | (2006.01) |
| ***A61J 7/04*** | (2006.01) |
| *G04G 13/02* | (2006.01) |
| *G04C 21/16* | (2006.01) |
| *G04G 11/00* | (2006.01) |

(52) U.S. Cl.

CPC ..... *A61J 7/0418* (2015.05); *A61J 7/0481* (2013.01); *G04C 21/16* (2013.01); *G04G 11/00* (2013.01); *G04G 13/026* (2013.01)

(58) Field of Classification Search

CPC ..... G04B 47/00; G04G 13/026; G04G 11/00; A61J 7/0418; A61J 7/0481

See application file for complete search history.

(56) References Cited

U.S. PATENT DOCUMENTS

| | | | | |
|---|---|---|---|---|
| 6,249,717 | B1 * | 6/2001 | Nicholson | A61J 7/0481 222/246 |
| 6,301,196 | B1 * | 10/2001 | Daniel | A61J 7/0481 368/10 |
| 6,324,123 | B1 * | 11/2001 | Durso | A61J 7/0481 221/15 |
| 7,907,477 | B2 * | 3/2011 | Puzia | A61J 7/0472 215/230 |
| 7,993,055 | B2 * | 8/2011 | Nurse | A61J 7/0481 368/244 |
| 8,717,851 | B1 * | 5/2014 | Nurse | A61J 7/0481 368/10 |
| 2002/0093427 | A1 * | 7/2002 | Roth | A61J 1/03 340/573.1 |
| 2003/0063522 | A1 * | 4/2003 | Sagar | A61J 7/0481 368/10 |

* cited by examiner

*Primary Examiner* — Sean Kayes
(74) *Attorney, Agent, or Firm* — Dunlap Bennett & Ludwig PLLC

(57) ABSTRACT

A medication administration tracker is provided. The medication administration tracker includes a medication container, such as an IV bag, vitamin organizer, prescription bottle and the like. If the present invention is a prescription bottle, a lid is releasably securable to the bottle. The present invention may include at least one indicator configured to produce an indication when prompted. A time keeper and a processor are integrated into the lid. The time keeper keeps time and the processor is operatively connected to the indicator and the time keeper. The processor is programmable to receive at least a dosage time and activate the indicator when the time keeper reaches the dosage time.

10 Claims, 3 Drawing Sheets

MEDICATION ADMINISTRATION TRACKER

BACKGROUND OF THE INVENTION

The present invention relates to the administration of medication and, more particularly, to a tracker device to aid in the administration of medication.

Medication containers may include IV bags, prescription bottles, pill organizers, and the like. Prescription bottles are containers that contain medicine prescribed by physicians. Prescription bottles are generally found in pharmacies. Prescription bottles have been around since the 19th-century. Standard prescription bottles state in writing on a label when to take a medication. However, patients may forget to take the medication. Alternatively, patients may forget that they took the medication and take too many, which can be dangerous.

As can be seen, there is a need for a device that provides a reminder for the administration of medication.

SUMMARY OF THE INVENTION

In one aspect of the present invention, a medication administration tracker comprises: a medication container comprising an internal housing sized to store a medication; at least one indicator configured to produce an indication when prompted; a time keeper integrated into the medication container and operable to keep time; and a processor integrated into the medication container and operatively connected to the at least one indicator and the time keeper, wherein the processor is programmable to receive at least a dosage time and activate the at least one indicator when the time keeper reaches the dosage time.

These and other features, aspects and advantages of the present invention will become better understood with reference to the following drawings, description and claims.

DETAILED DESCRIPTION OF THE INVENTION

Figure 1:
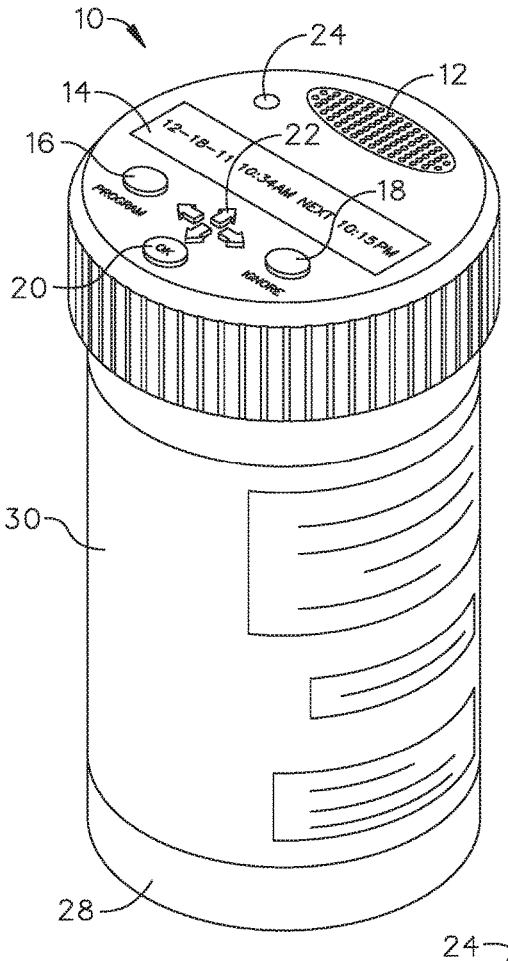
FIG. 1 is a perspective view of an embodiment of the present invention, shown in use.
Figure 2:
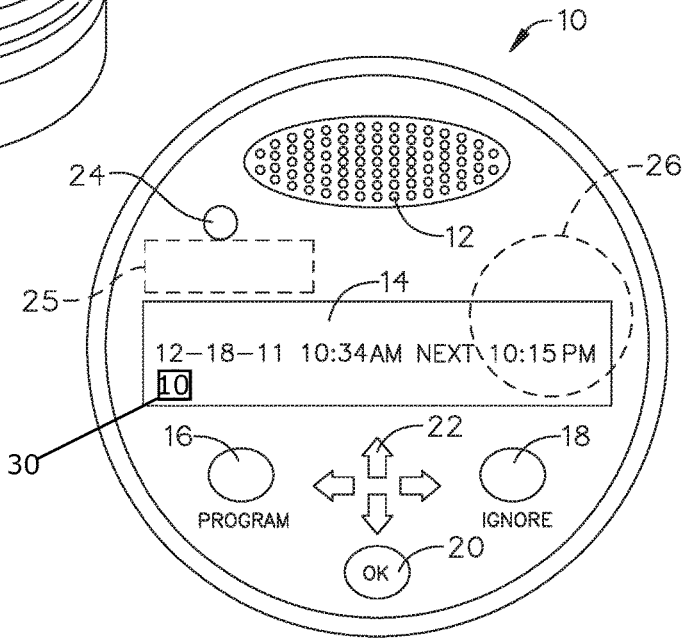
FIG. 2 is a top view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention is used to assist individuals in correctly self-administering medications as prescribed. The present invention may know when it was last opened preventing double dosage of a drug, and remind clients when they need to take their medication. The present invention eliminates the need to remember if and when a medication was taken. The present invention may include programmable timer enclosed in a plastic lid with buttons that allow the programming to create a schedule (once a day at 9 am, four times a day at 8 am, noon, 4 pm, and 8 pm, etc.)

The intelligent vial lid may contain the equivalent of a wrist watch with multiple timers that can be programmatically set. When it is time for a patient to take medication, the lid may know the time of day it is, the time of day to alert the patient, the quantity or number of tablets or ounces of liquid that are to be administered, and deduct that quantity from the originally loaded quantity. In normal daily use, a patient taking a one tablet medication twice a day might open the vial at 9 am to take a morning dose and at 9 pm to take an evening dose. If the original dispense quantity was a one month supply, 60 tablets or capsules would be in the vial. After the 9 am does, a counter may either automatically or manually deduct "1" from the counter to 59, after the 9 pm dose, the counter would state "58" tablets remaining and so on. The intelligent lid may also alert the client when they need to reorder the medication if refills are available.

Referring to 1 through 5, the present invention includes a medication administration tracker. The medication administration tracker includes a medication container, such as an IV bag, vitamin organizer, prescription bottle and the like. If the present invention is a prescription bottle, a lid 10 is releasably securable to the bottle 28. The present invention may include at least one indicator 12, 24 configured to produce an indication when prompted. A time keeper 25 and a processor 26 are integrated into the lid 10. The time keeper 25 and the processor 26 may be part of the same device or separate components. The time keeper 25 keeps time and the processor 26 is operatively connected to the indicator 12, 24 and the time keeper 25. The processor 26 is programmable to receive at least a dosage time and activate the indicator 12, 24 when the time keeper 25 reaches the dosage time. The present invention may be powered by a battery.

In certain embodiments, the indicator 12, 24 may include a speaker 12. Therefore, when the dosage time has been reached a sound may be emitted from the speaker 12. The indicator 12, 24 may further include a light 24. Therefore, when the dosage time has been reached the light 24 may be activated. In certain embodiments, the present invention may include a remote indicator. In such embodiments, the processor 26 may include a wireless transmitter operable to connect with and produce the indication on the remote device. For example, the wireless transmitter may be Bluetooth® which communicates with a smart device, such as a phone, and produces an indicator, such as a text message.

The present invention may further include a display 14. The display 14 may be operatively connected to the time keeper 25 and the processor 26 and may produce at least the current time and the dosage time. The time keeper 25 may also keep track of the day, month and year. Therefore, the display 14 may further produce the date.

The processor 26 may be operable to receive additional data to enhance the functionality of the lid 10. In certain embodiments, the processor 26 is programmable to receive a total medication amount 30 and a dosage amount. Therefore, the user may enter the total amount of pills in the bottle 28 and the amount of pills to take for each dosage. In certain embodiments, the processor 26 may update the total medication amount 30 when the time keeper 25 reaches the dosage time. The total medication amount 30 is changed and produced on the display so the user knows how much medication is left within the bottle 28.

The present invention may further include a plurality of buttons to operate the time keeper 25 and processor 26. For example, navigation buttons 22 and a program button 16 may be used to set the time, enter the dosage time, enter the dosage amount, enter the medication amount, and the like. In certain embodiments, the present invention may include an ignore button 18 operatively connected to the processor 26. In such embodiments, when the time keeper 25 reaches the dosage time, the ignore button 18 is activated if the user chooses not to update the medication amount. Further, the present invention may include an enter button 20 in order to indicate medication has been taken and to update the medication amount.

Figure 3:
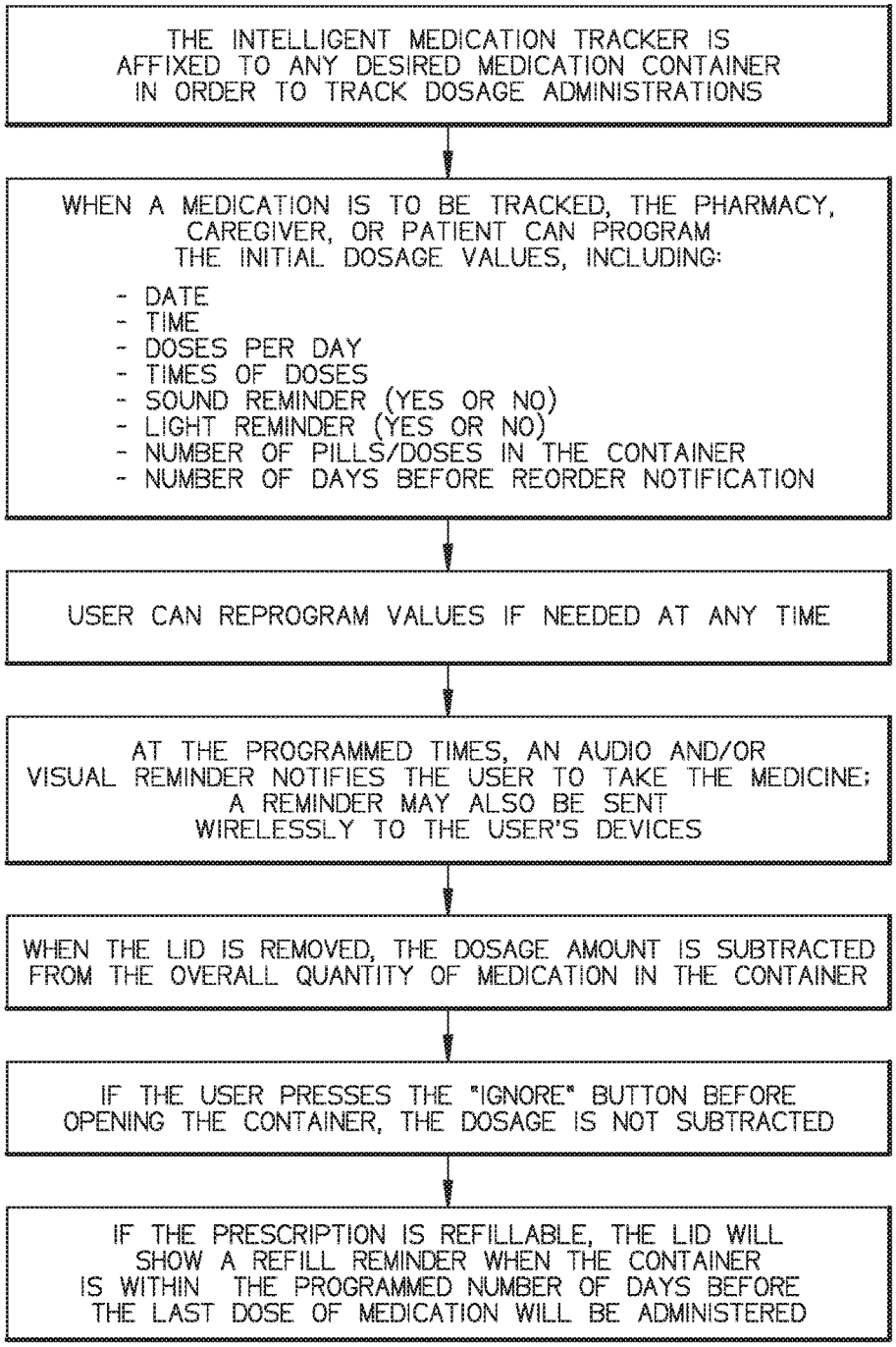
FIG. 3 is a flow chart of an embodiment of the present invention.
Figure 4:
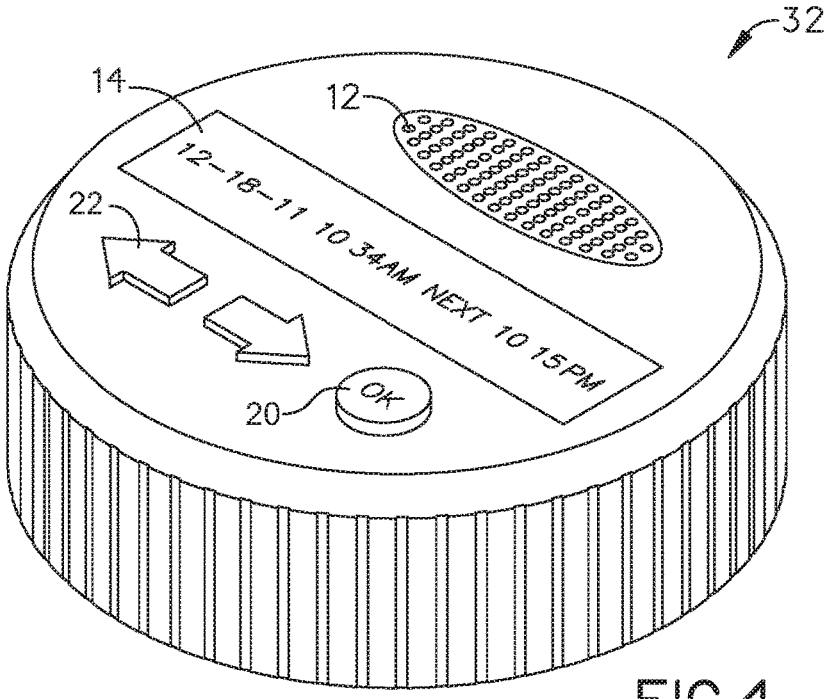
FIG. 4 is a perspective view of an alternate embodiment of the present invention.
Figure 5:
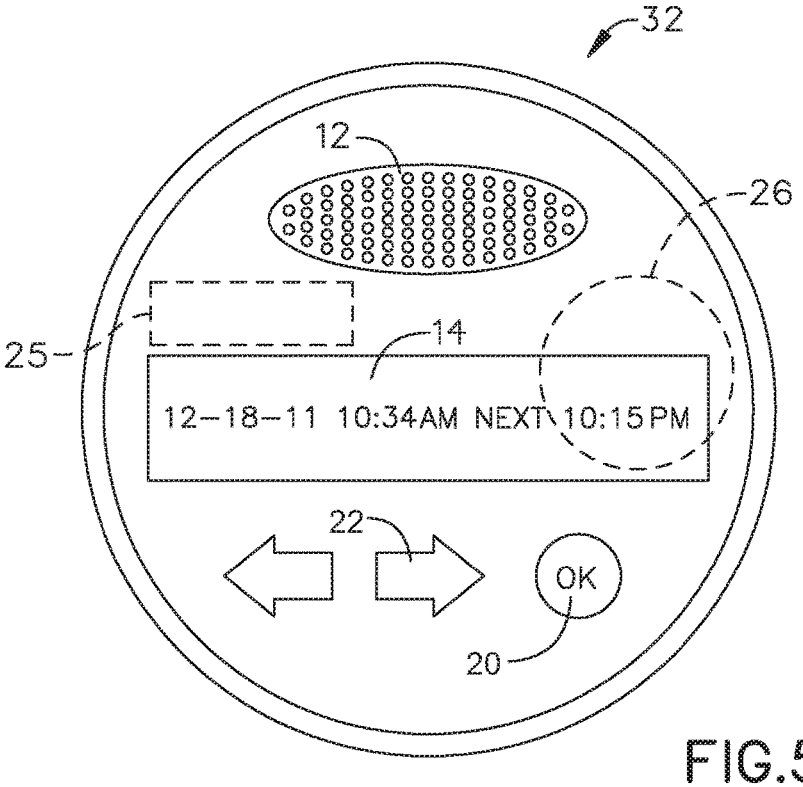
FIG. 5 is a top view of an alternate embodiment of the present invention.

A method of using the present invention is demonstrated in the flow chart of FIG. 3. A user may affix the lid to any desired medication container in order to track the dosage administrations. The pharmacy caregiver or the patient may program the lid. The lid may be programmed by entering the date, time, dosages per day, time of dosages, activating a sound and/or light reminder, entering the number of pills and the dosage amount, and entering the number of days before a reorder notification is desired. The user may reprogram values at any time if needed. When the programmed time is reached, the audio and/or visual reminder notifies the user to take the medicine. In certain embodiments, a reminder is also wirelessly sent to a user's remote device. When the lid is removed, the dosage amount may be subtracted from the overall quantity of medication in the bottle. Alternatively, the enter button may be pressed to subtract from the overall quantity. If the user presses the ignore button, the dosage amount is not subtracted from the overall quantity of the medication. If the prescription is refillable, the lid may indicate when the bottle needs to be refilled when the container is within the programmed number of days before the last dose of medication will be administered.

It should be understood, of course, that the foregoing relates to exemplary embodiments of the invention and that modifications may be made without departing from the spirit and scope of the invention as set forth in the following claims.

What is claimed is:

1. A medication administration tracker comprising:

a medication container sized to store a medication;

at least one indicator configured to produce an indication when prompted;

a time keeper integrated into the medication container and operable to keep time;

a processor integrated into the medication container and operatively connected to the at least one indicator and the time keeper, wherein the processor is programmable to receive:

a current time and a dosage time and activate the at least one indicator when the time keeper reaches the dosage time, and a total medication amount and a dosage amount, wherein the processor updates the total medication amount when the time keeper reaches the dosage time, and a display operatively connected to the time keeper and the processor, wherein the display produces the current time, the dosage time and the total medication amount.

2. The medication administration tracker of claim 1, wherein the medication container comprises a medication bottle and a lid releasably securable to a medication bottle.

3. The medication administration tracker of claim 2, wherein the at least one indicator, the time keeper, and the processer are integrated into the lid.

4. The medication administration tracker of claim 1, wherein the at least one indicator is a speaker.

5. The medication administration tracker of claim 1, wherein the at least one indicator is a light.

6. The medication administration tracker of claim 1, further comprising a plurality of buttons attached to the medication container and operable to control the time keeper and the processor.

7. The medication administration tracker of claim 6, further comprising an ignore button operatively connected to the processor, wherein when the time keeper reaches the dosage time and the ignore button is activated, the total medication amount is not updated.

8. The medication administration tracker of claim 7, further comprising an enter button operatively connected to the processor, wherein when the time keeper reaches the dosage time and the enter button is activated, the total medication amount is updated.

9. The medication administration tracker of claim 1, wherein the display further produces a current date.

10. The medication administration tracker of claim 1, wherein the process further comprises a wireless transmitter operable to connect with and produce the indication on a remote device.

* * * * *